US008714708B2

(12) United States Patent
Kuwata

(10) Patent No.: US 8,714,708 B2
(45) Date of Patent: May 6, 2014

(54) LIQUID EJECTION HEAD AND IMAGE FORMING APPARATUS INCLUDING SAME

(75) Inventor: Masahiro Kuwata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/619,016

(22) Filed: Sep. 14, 2012

(65) Prior Publication Data

US 2013/0070026 A1 Mar. 21, 2013

(30) Foreign Application Priority Data

Sep. 16, 2011 (JP) ..... 2011-202983

(51) Int. Cl.
*B41J 2/14* (2006.01)

(52) U.S. Cl.
USPC ..... 347/47

(58) Field of Classification Search
USPC ..... 347/47
See application file for complete search history.

(56) References Cited

U.S. PATENT DOCUMENTS

| | | | | |
|---|---|---|---|---|
| 4,680,595 | A * | 7/1987 | Cruz-Uribe et al. | 347/40 |
| 6,309,057 | B1 * | 10/2001 | Kobayashi et al. | 347/71 |
| 2012/0069093 | A1 | 3/2012 | Kuwata et al. | |

FOREIGN PATENT DOCUMENTS

| | | |
|---|---|---|
| JP | 2006-044083 | 2/2006 |
| JP | 2006-159661 | 6/2006 |
| JP | 2006-175668 | 7/2006 |
| JP | 2007-160624 | 6/2007 |
| JP | 2007-290214 | 11/2007 |
| JP | 2008-221661 | 9/2008 |
| JP | 2011-086896 | 4/2011 |

* cited by examiner

*Primary Examiner* — Matthew Luu
*Assistant Examiner* — Alexander D Shenderov
(74) *Attorney, Agent, or Firm* — Cooper & Dunham LLP

(57) ABSTRACT

A liquid ejection head including a nozzle plate having a nozzle array constructed of multiple nozzles, a channel member that forms multiple individual channels communicating with the multiple nozzles, a pressure generator to pressurize liquid within the multiple individual channels, and a common channel member that forms a common channel from which the liquid is supplied to the multiple individual channels. The channel member includes a first surface facing the common channel, a second surface provided at both ends of the channel member and protruding beyond the first surface toward a direction opposite a direction of flow of the liquid, and a third surface that connects the first and second surfaces. At least a gap between the common channel member and a part of the second surface is sealed by a seal member that forms a wall of the common channel between the channel member and the common channel member.

10 Claims, 18 Drawing Sheets

LIQUID EJECTION HEAD AND IMAGE FORMING APPARATUS INCLUDING SAME

CROSS-REFERENCE TO RELATED APPLICATION

The present patent application is based on and claims priority pursuant to 35 U.S.C. §119 from Japanese Patent Application No. 2011-202983, filed on Sep. 16, 2011 in the Japan Patent Office, which is incorporated by reference herein in its entirety.

BACKGROUND OF THE INVENTION

1. Field of the Invention

Exemplary aspects of the present invention generally relate to a liquid ejection head and an image forming apparatus including the liquid ejection head.

2. Description of the Related Art

One type of image forming apparatus such as a printer, copier, plotter, facsimile machine, or multifunction device having two or more of these capabilities is an inkjet recording device employing a liquid ejection recording method. The inkjet recording device includes a recording head constructed of a liquid ejection head that ejects droplets of a recording liquid such as ink onto a sheet of a recording medium to form an image on the sheet.

The liquid ejection head is generally constructed of a nozzle plate in which multiple nozzles are formed to eject liquid droplets, a channel plate that forms multiple individual channels respectively communicating with the multiple nozzles, and a vibration plate that forms part of the walls of the individual liquid channels. The nozzle plate, the channel plate, and the vibration plate are laminated and bonded together. The liquid ejection head further includes a common channel member that forms a common channel from which liquid is supplied to the multiple individual channels. The common channel member is often disposed opposite the channel plate with the vibration plate interposed therebetween.

Market demand for more compact image forming apparatuses continues unabated, and one key to a more compact apparatus is a more compact liquid ejection head. In order to make the liquid ejection head more compact, it is necessary to downsize the channel member that constitutes the individual channels.

BRIEF SUMMARY OF THE INVENTION

In view of the foregoing, illustrative embodiments of the present invention provide a novel compact liquid ejection head and an image forming apparatus including the liquid ejection head.

In one illustrative embodiment, a liquid ejection head includes a nozzle plate having a nozzle array constructed of multiple nozzles from which liquid droplets are ejectable, a channel member that forms multiple individual channels respectively communicating with the multiple nozzles, a pressure generator to pressurize liquid within the multiple individual channels, and a common channel member that forms a common channel from which the liquid is supplied to the multiple individual channels. The channel member includes a first surface facing the common channel and having inlets respectively communicating with the multiple individual channels, a second surface provided at both ends of the channel member in a direction in which the nozzle arrays extend and protruding beyond the first surface toward a direction opposite a direction of flow of the liquid into the multiple individual channels, and a third surface that connects the first and second surfaces. At least a gap between the common channel member and a part of the second surface is sealed by a seal member that forms a wall of the common channel between the channel member and the common channel member in the direction in which the nozzle arrays extend.

In another illustrative embodiment, an image forming apparatus includes the liquid ejection head described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 15(*b*) is a vertical cross-sectional view along a line A1-A1 in FIG. 15(*a*);

FIG. 16(*b*) is a vertical cross-sectional view along a line A2-A2 in FIG. 16(*a*);

FIG. 17(*b*) is a vertical cross-sectional view along a line A3-A3 in FIG. 17(*a*);

FIG. 18(*b*) is a vertical cross-sectional view along a line A4-A4 in FIG. 18(*a*);

FIG. 19(*b*) is a vertical cross-sectional view along a line A5-A5 in FIG. 19(*a*);

FIG. 20(*b*) is a vertical cross-sectional view along a line A6-A6 in FIG. 20(*a*);

FIG. 21(*b*) is a vertical cross-sectional view along a line A7-A7 in FIG. 21(*a*);

FIG. 22(*b*) is a vertical cross-sectional view along a line A8-A8 in FIG. 22(*a*);

FIG. 22(*c*) is a vertical cross-sectional view along a line B1-B1 in FIG. 22(*a*);

FIG. 23(*b*) is a vertical cross-sectional view along a line A9-A9 in FIG. 23(*a*):

FIG. 23(*c*) is a vertical cross-sectional view along a line B2-B2 in FIG. 23(*a*);

FIG. 23(*d*) is a vertical cross-sectional view along a line C1-C1 in FIG. 23(*a*);

FIG. 24(*b*) is a vertical cross-sectional view along a line A10-A10 in FIG. 24(*a*);

FIG. 24(*c*) is a vertical cross-sectional view along a line B3-B3 in FIG. 24(*a*);

FIG. 24(*d*) is a vertical cross-sectional view along a line C2-C2 in FIG. 24(*a*);

FIG. 25(*b*) is a vertical cross-sectional view along a line A11-A11 in FIG. 25(*a*);

FIG. 25(*c*) is a vertical cross-sectional view along a line B4-B4 in FIG. 25(*a*);

FIG. 25(*d*) is a vertical cross-sectional view along a line C3-C3 in FIG. 25(*a*);

DETAILED DESCRIPTION OF ILLUSTRATIVE EMBODIMENTS

Figure 1:
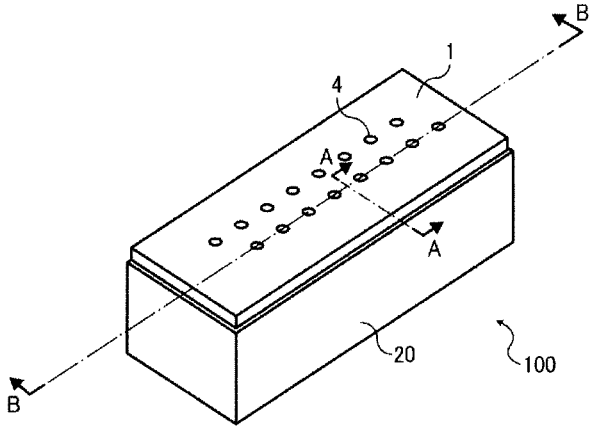
FIG. 1 is a perspective view illustrating the external appearance of an example of a liquid ejection head according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a "sheet" of recording media is not limited to a sheet of paper but also includes any material onto which liquid droplets including ink droplets adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns.

In addition, ink includes any material which is a liquid when ejected from the image forming apparatuses to form images on the recording medium, such as a DNA sample, a resist material, a pattern material, and resin.

Further, an image formed on the recording medium is not limited to a flat image, but also includes an image formed on a three-dimensional object, a three-dimensional image, and so forth.

Figure 2:
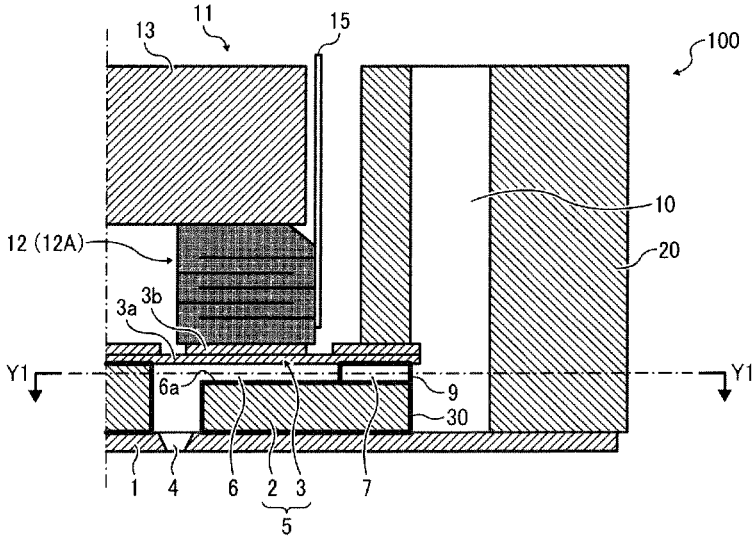
FIG. 2 is a vertical cross-sectional view along a line A-A in FIG. 1.
Figure 3:
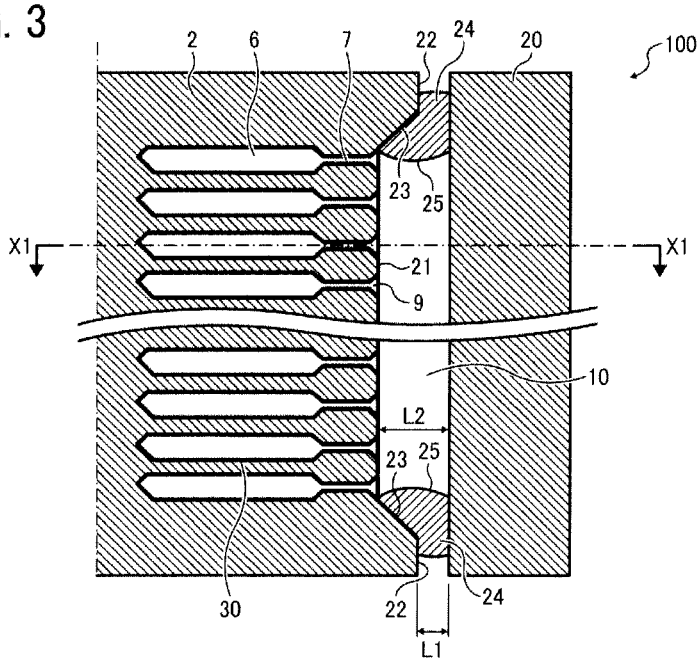
FIG. 3 is a horizontal cross-sectional view along a line Y1-Y1 in FIG. 2.
Figure 4:
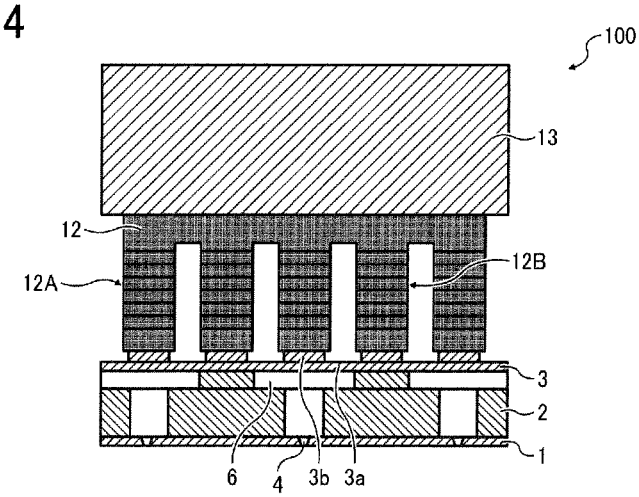
FIG. 4 is a vertical cross-sectional view along a line B-B in FIG. 1.

A description is now given of a configuration and operation of a liquid ejection head 100 according to a first illustrative embodiment, with reference to FIGS. 1 to 4. FIG. 1 is a perspective view illustrating the external appearance of an example of the liquid ejection head 100. FIG. 2 is a vertical cross-sectional view along a line A-A in FIG. 1, which corresponds to a line X1-X1 in FIG. 3. FIG. 3 is a horizontal cross-sectional view along a line Y1-Y1 in FIG. 2. FIG. 4 is a vertical cross-sectional view along a line B-B in FIG. 1.

In the liquid ejection head 100, a nozzle plate 1, a channel plate (chamber substrate) 2, and a vibration plate 3 are laminated and bonded together. The liquid ejection head 100 further includes a pressure generator, which in the present illustrative embodiment is a piezoelectric actuator 11 that displaces the vibration plate 3, and a common channel member, which, in the present illustrative embodiment, is a common liquid chamber member 20 that forms a frame of the liquid ejection head 100. The channel plate 2 and the vibration plate 3 together constitute a channel member 5.

The nozzle plate 1, the channel plate 2, and the vibration plate 3 together form individual channels, which, in the present illustrative embodiment, are individual liquid chambers 6 respectively communicating with multiple nozzles 4 formed in the nozzle plate 1 to eject liquid droplets, and liquid supply channels 7 that supply liquid to the individual liquid chambers 6, respectively. Each of the liquid supply channels 7 also functions as a liquid resistor.

The liquid is supplied to the multiple individual liquid chambers 6 from a common channel in the common liquid chamber member 20, which, in the present illustrative embodiment, is a common liquid chamber 10, via the liquid supply channels 7. An inlet 9 is provided to each of the liquid supply channels 7 that communicate with the individual liquid chambers 6, respectively. Specifically, the inlets 9 face the common liquid chamber 10 and communicate with the individual liquid chambers 6 via the liquid supply channels 7, respectively.

The nozzle plate 1 is formed of a metal such as nickel and may be produced by electroforming process. Alternatively, other metal members, resin members, or laminated members constructed of resin layers and metal layers may be used as the nozzle plate 1. The multiple nozzles 4, each having a diameter of from 10 μm to 35 μm, are formed in the nozzle plate 1 at positions corresponding to the individual liquid chambers 6, respectively, so that nozzle arrays each constituted of the multiple nozzles 4 are provided to the nozzle plate 1. The nozzle plate 1 is bonded together with the channel plate 2 with adhesive. A water-repellent layer is provided on a liquid droplet ejection side of the nozzle plate 1 opposite a side of the nozzle plate 1 facing the individual liquid chambers 6.

The channel plate 2 is formed of a monocrystalline substrate. The monocrystalline substrate is etched to form grooves 6*a* that constitute the individual liquid chambers 6, the liquid supply channels 7, and so forth. An overcoat 30 is provided to a surface of the channel plate 2, as described in detail later. It is to be noted that, alternatively, the channel plate 2 may be formed by etching a metal plate such as an SUS substrate using an acid etchant or may be formed by machining such as press working.

The vibration plate 3 forms walls of the grooves 6*a* that constitute the individual liquid chambers 6. The vibration plate 3 has vibrating portions (diaphragms) 3*a* each corresponding to the individual liquid chambers 6, respectively, to form part of the walls of the individual liquid chambers 6. Each of the vibrating portions 3*a* has a protrusion 3*b*.

A drive unit that deforms the vibrating portions 3*a* of the vibration plate 3, which, in the present illustrative embodiment, is the piezoelectric actuator 11 including an electromechanical transducer, is disposed facing a side of the vibration plate 3 opposite a side facing the individual liquid chambers 6.

The piezoelectric actuator 11 includes multiple laminate-type piezoelectric members 12 bonded to a base member 13 with adhesive. Grooves are formed in the piezoelectric members 12 by half-cut dicing so that each of the piezoelectric members 12 has a predetermined number of piezoelectric columns 12A and 12B positioned at predetermined intervals.

The piezoelectric columns 12A and 12B have the same basic configuration. A drive waveform is supplied to the piezoelectric columns 12A (hereinafter also referred to as drive columns 12A) to drive the drive columns 12A, and no drive waveform is supplied to the piezoelectric columns 12B (hereinafter also referred to as non-drive columns 12B) so that the non-drive columns 12B are used merely as columns.

An end face of each of the drive columns 12A is bonded to the vibrating potions 3*a* of the vibration plate 3. Each of the piezoelectric members 12 is constructed of piezoelectric layers and internal electrodes, both of which are laminated alternately. Each of the internal electrodes is drawn out to an end face of each of the piezoelectric members 12 and is provided with an external electrode. The external electrode of each of the drive columns 12A is connected to a flexible wiring board, which, in the present illustrative embodiment, is a flexible printed circuit (FPC) 15 that supplies a drive signal to the external electrode.

The common liquid chamber member 20 constitutes the frame of the liquid ejection head 100 and is formed by injection molding using, for example, epoxy resin or thermoplastic resin such as polyphenylene sulfide. The common liquid chamber member 20 is bonded to the periphery of the nozzle plate 1 and edges of the vibration plate 3 with adhesive at different levels in a direction perpendicular to a direction of the nozzle arrays.

In the liquid ejection head 100 having the above-described configuration, a voltage supplied to the drive columns 12A is reduced from a reference level to contract the drive columns 12A so that the vibrating portions 3*a* of the vibration plate 3 are deformed to expand the volume of each of the individual liquid chambers 6, thereby forcing liquid into the individual liquid chambers 6. Thereafter, the voltage supplied to the drive columns 12A is increased to extend the drive columns 12A in a direction of lamination so that the vibrating portions 3*a* of the vibration plate 3 are deformed toward the nozzles 4 to contract the volume of each of the individual liquid chambers 6. As a result, pressure is applied to the liquid within the individual liquid chambers 6 so that liquid droplets are ejected from the nozzles 4.

Then, the voltage supplied to the drive columns 12A is returned to the reference level to restore the vibrating portions 3*a* of the vibration plate 3 to their initial positions so that the individual liquid chambers 6 are expanded, thereby generating negative pressure. As a result, the liquid flows from the common liquid chamber 10 to the individual liquid chambers 6 via the liquid supply channels 7 to fill the individual liquid chambers 6. After vibration of a meniscus formed in each of the nozzles 4 is damped, the next series of ejection of liquid droplets is started.

It is to be noted that the method for driving the liquid ejection head 100 is not limited to the above-described example, and may be varied depending on the exact manner in which the driving waveform is applied.

A description is now given of bonding of the channel member 5 constructed of the channel plate 2 and the vibration plate 3 to the common liquid chamber member 20 in the direction of the nozzle arrays with reference to FIG. 3.

An end face of the channel member 5 in a direction of flow of the liquid into the individual liquid chambers 6, that is, from the common liquid chamber 10 to the nozzles 4, faces the common liquid chamber 10.

The end face of the channel member 5 is constructed of a first surface 21 in which the inlets 9 of the individual liquid chambers 6 are formed, second surfaces 22 provided at both ends of the end face in the direction of the nozzle arrays outboard of the first surface 21, and third surfaces 23 that connect the first and second surfaces 21 and 22, respectively. The second surfaces 22 protrude toward a direction opposite the direction of flow of the liquid beyond the first surface 21.

The third surfaces 23 are provided at a slant, respectively, such that the end face of the channel member 5 has a tapered shape from the second surfaces 22 to the first surface 21. It is to be noted that each of the third surfaces 23 may be either flat or curved.

Portions between the common liquid chamber member 20 and ranges in the channel member 5 from the second surfaces 22 to the third surfaces 23 are respectively sealed by a seal member, which, in the present illustrative embodiment, is an adhesive 24.

Each of the adhesives 24 forms a wall 25 of the common liquid chamber 10 between the channel member 5 and the common liquid chamber member 20.

Thus, the common liquid chamber member 20 is bonded to the second surfaces 22 of the channel member 5, which protrude beyond the first surface 21 having the inlets 9 of the individual liquid chambers 6, so that a distance L1 between bonding surfaces of the channel member 5, that is, the second surfaces 22, and the common liquid chamber member 20 can be reduced.

Accordingly, an amount of the adhesives 24 used for bonding the channel member 5 and the common liquid chamber member 20 together can be reduced, thereby preventing the inlets 9 of the individual liquid chambers 6 from being clogged with excess adhesive.

Meanwhile, the first surface 21 having the inlets 9 of the individual liquid chambers 6 is recessed toward the individual liquid chambers 6 compared to the bonding surfaces, that is, the second surfaces 22, so that a width L2 of the common liquid chamber 10 formed by the channel member 5, the nozzle plate 1, and the common liquid chamber member 20 (or a distance L2 between the first surface 21 of the channel member 5 and the common liquid chamber member 20) can be increased. As a result, resistance of the liquid flowing into the liquid supply chambers 7 can be reduced to securely supply the liquid to the individual liquid chambers 6, thereby achieving stable ejection of the liquid droplets and thus providing higher-quality images.

Figure 5:
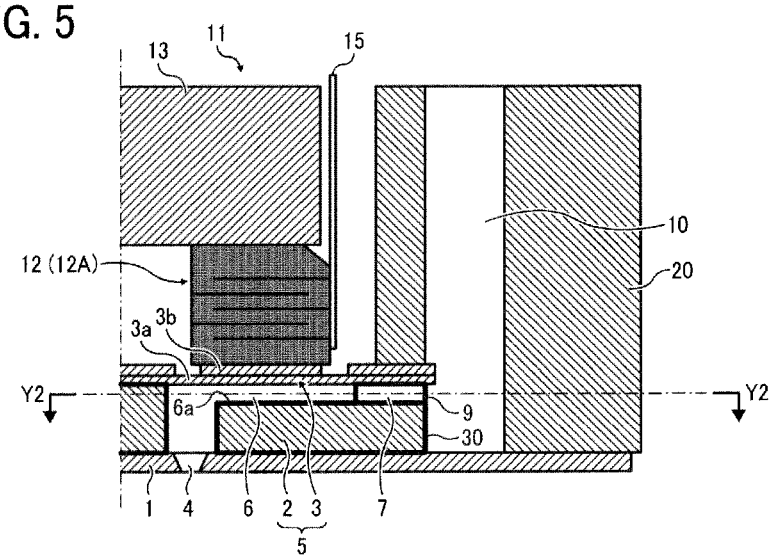
FIG. 5 is a vertical cross-sectional view illustrating a configuration of a liquid ejection head according to a first comparative example in a direction perpendicular to a direction of nozzle arrays.
Figure 6:
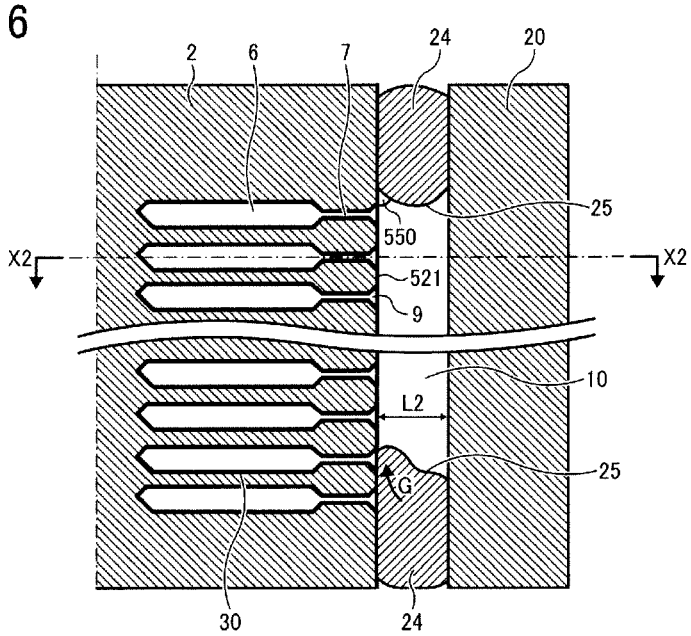
FIG. 6 is a horizontal cross-sectional view along a line Y2-Y2 in FIG. 5.
Figure 7:
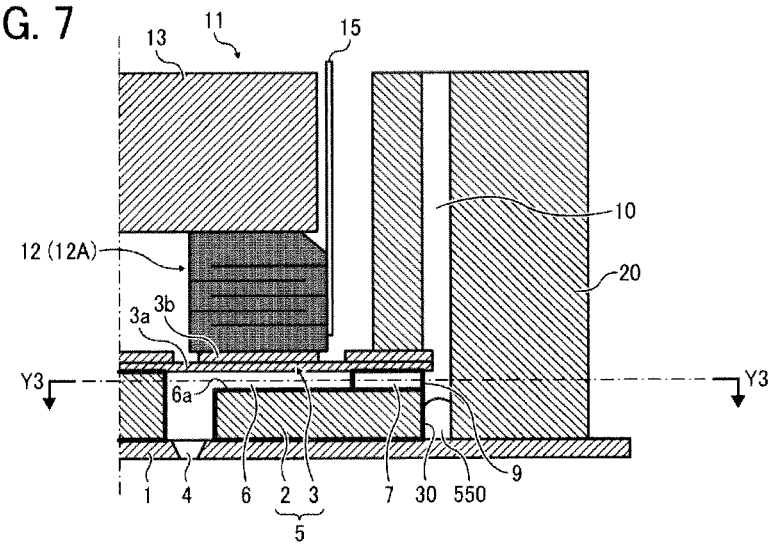
FIG. 7 is a vertical cross-sectional view illustrating a configuration of a liquid ejection head according to a second comparative example in the direction perpendicular to the direction of the nozzle arrays.
Figure 8:
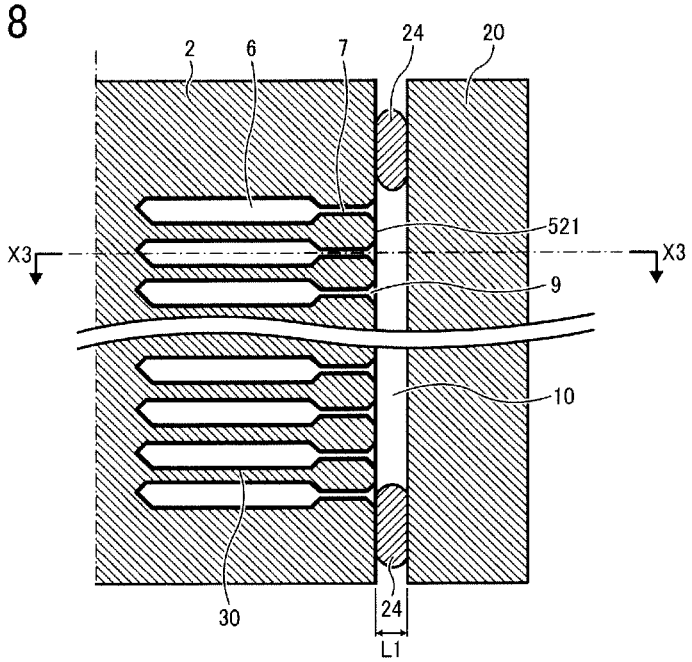
FIG. 8 is a horizontal cross-sectional view along a line Y3-Y3 in FIG. 7.

The unobvious effects achieved by the first illustrative embodiment are described in more detail below using comparative examples, with reference to FIGS. 5 to 8. FIG. 5 is a vertical cross-sectional view illustrating a configuration of a liquid ejection head according to a first comparative example in the direction perpendicular to the direction of the nozzle arrays (which corresponds to a cross-section along a line X2-X2 in FIG. 6). FIG. 6 is a horizontal cross-sectional view along a line Y2-Y2 in FIG. 5. FIG. 7 is a vertical cross-sectional view illustrating a configuration of a liquid ejection head according to a second comparative example in the direction perpendicular to the direction of the nozzle arrays (which corresponds to a cross-section along a line X3-X3 in FIG. 8). FIG. 8 is a horizontal cross-sectional view along a line Y3-Y3 in FIG. 7.

In both the first and second comparative examples, the end face of the channel member 5 in the direction perpendicular to the direction of the nozzle arrays only has a flat surface 521 that corresponds to the first surface 21 of the channel member 5 according to the first illustrative embodiment. The flat surface 521 of the channel member 5 according to the first comparative example is bonded to the common liquid chamber member 20 with the adhesives 24 so that the adhesives 24 form the walls 25 of the common liquid chamber 10, respectively.

The common liquid chamber 10 is required to securely supply the liquid to the individual liquid chambers 6. Therefore, after the liquid droplets are ejected from the nozzles 4, the common liquid chamber 10 needs to promptly secure a sufficient amount of liquid to be supplied to the individual liquid chambers 6 for the next series of ejection of the liquid droplets.

For these reasons, a predetermined distance that corresponds to the width L2 of the common liquid chamber 10 according to the first illustrative embodiment must be provided between the surface 521 of the channel member 5 and the common liquid chamber member 20 in the direction perpendicular to the direction of the nozzle arrays.

In a case in which the distance L2 is provided between the surface 521 of the channel member 5 and the common liquid chamber member 20 as illustrated in FIG. 6, a large amount of the adhesives 24 is needed to fill a gap between the surface 521 and the common liquid chamber member 20. Consequently, because the adhesives 24 may displace before solidifying, each of the adhesives 24 needs to be supplied to a position apart from the inlets 9 of the individual liquid chambers 6 as shown by the upper adhesive 24 in FIG. 6. When the adhesives 24 are provided apart from the inlets 9 of the individual liquid chambers 6 positioned at both ends in the direction of the nozzle arrays, recessed portions are formed between the surface 521 and the adhesives 24, respectively. As a result, a cavity region where the liquid tends not to flow is generated, possibly resulting in accumulation of bubbles 550 at each of the recessed portions.

Entry of the bubbles 550 in the individual liquid chambers 6 caused by reciprocal movement of a carriage mounting the liquid ejection head 100 during image formation causes no ejection or irregular ejection of the liquid droplets, thereby degrading image quality.

By contrast, when the adhesives 24 are supplied to portions near the inlets 9 of the individual liquid chambers 6 provided at both ends in the direction of the nozzle arrays as shown by the lower adhesive 24 in FIG. 6, the adhesives 24 may displace in a direction indicated by arrow G in FIG. 6. Consequently, the inlets 9 of the individual liquid chambers 6 may be clogged with the adhesives 24 and supply of the liquid to the individual liquid chambers 6 may be prevented altogether, thereby causing irregular ejection of the liquid droplets.

In the second comparative example, the distance L1 between a bonding surface of the channel member 5 and the common liquid chamber member 20 is reduced as illustrated in FIG. 8. Accordingly, an amount of the adhesives 24 used for bonding the channel member 5 and the common liquid chamber member 20 together is also reduced, and a width of each of the adhesives 24 in the direction perpendicular to the direction of the nozzle arrays is reduced. As a result, positions to which the adhesives 24 are provided can be easily controlled, thereby reducing generation of the cavity region caused by the recessed portions and preventing displacement of the adhesives 24 into the inlets 9 shown in FIG. 6.

However, reduction in the distance L1 between the bonding surface of the channel member 5 and the common liquid chamber member 20 causes reduction in the volume of the common liquid chamber 10 because the surface 521 is flat. Consequently, the liquid resistance in the common liquid chamber 10 is increased. As a result, the liquid cannot be sufficiently supplied to the individual liquid chambers 6 after ejection of the liquid droplets from the nozzles 4, possibly causing no ejection of the liquid droplets.

In addition, reduction in the distance between the surface 521 of the channel member 5 and the common liquid chamber member 20 forms narrow recessed portions between the surface 521, the common liquid chamber member 20, and the nozzle plate 1. As a result, the bubbles 550 tend to accumulate at those portions as shown in FIG. 7. It is difficult to remove the bubbles 550 by filling the liquid ejection head 100 with the liquid. Consequently, the bubbles 550 may be moved upward and enter the individual liquid chambers 6 via the inlets 9 during image formation, causing irregular ejection of the liquid droplets and thus resulting in irregular images.

By contrast, in the first illustrative embodiment, the second surfaces 22 of the channel member 5 protrude toward the common liquid chamber member 20 beyond the first surface 21 having the inlets 9 of the individual liquid chambers 6 in the direction opposite the direction of flow of the liquid, that is, the direction perpendicular to the direction of the nozzle arrays, and the common liquid chamber member 20 is bonded to the second surfaces 22 of the channel member 5. Accordingly, the volume of the common liquid chamber 10 can be sufficiently secured in a similar manner to the first comparative example illustrated in FIGS. 5 and 6, and at the same time control of the positions of the adhesives 24 can be facilitated in a similar manner to the second comparative example illustrated in FIGS. 7 and 8.

The first, second, and third surfaces 21, 22, and 23 of the channel member 5 according to the first illustrative embodiment are described in more detail below.

As described previously, the third surfaces 23 are provided at a slant to taper the end face of the channel member 5 from the second surfaces 22 to the first surface 21 in the direction of flow of the liquid. As a result, when the channel member 5 and the common liquid chamber member 20 are bonded together with the adhesives 24, excess adhesives 24 can expand in a wider region, thereby reliably preventing the adhesives 24 from entering the inlets 9 of the individual liquid chambers 6.

Each of the third surfaces 23 that form the tapered portion of the channel member 5 may be formed by a surface of a monocrystalline silicon substrate having a slower etching rate in a case in which the channel plate 2 is formed of the monocrystalline silicon substrate. In such a case, it is preferable that the first surface 21 be formed by a surface having the overcoat 30 thereon including the etched surface of the channel plate 2. As a result, the first surface 21 of the channel member 5 is prevented from being dissolved by the liquid.

The overcoat 30 may be fixed to the silicon substrate by thermal oxidation of the silicon substrate after etching process to form a thermally oxidized silicon film, coating the silicon substrate with a resin film such as Teflon®, silicone, and polyimide, or burning. Alternatively, the overcoat 30 may be provided to the channel plate 2 by coating the channel plate 2 with metal or inorganic materials such as SiN and $SiO_2$.

The second surfaces 22 are sealed with the adhesives 24 and are disposed outside the common liquid chamber 10. Thus, the second surfaces 22 do not directly contact the liquid. Accordingly, provision of the overcoat 30 to the second surfaces 22 is not necessary, and therefore the second surfaces 22 can be formed solely by machining. As a result, the silicon substrate can be divided into individual channel plates 2 by machining after the multiple channel plates 2 each having the individual liquid chambers 6 and the liquid supply paths 7 are formed in the silicon substrate by etching and the overcoat 30 is formed together with each of the channel plates 2, thereby improving productivity of the channel plate 2. Examples of machining include, but are not limited to, abrasive dicing, laser dicing, and separation by cleavage.

In the machining, abrasive dicing generates dicing dust scraped off by abrasive grains. If the inlets 9 are formed by abrasive dicing, the dicing dust may enter the grooves 6*a* that constitute the liquid supply channels 7 and the individual liquid chambers 6, thereby possibly causing clogging of the nozzles 4 with the dicing dust during ejection of the liquid droplets. In addition, laser dicing tends to generate dust during abrasion or formation of fragile layers using laser irradiation. Consequently, the nozzles 4 may be clogged with the dust during ejection of the liquid droplets. Separation by cleavage also tends to generate dust by crack or formation of fragile layers during cleavage. Consequently, the nozzles 4 may be clogged with the dust during ejection of the liquid droplets. Further, chipping tends to occur a mechanically-processed surface, thereby possibly clogging the nozzles 4 with foreign substances caused by chipping.

However, the second surfaces 22 of the channel member 5 according to the first illustrative embodiment are sealed with the adhesives 24 and therefore disposed outside the common liquid chamber 10. Accordingly, dust generated during machining or cleavage or foreign substances caused by chipping do not enter the common liquid chamber 10 even when the second surfaces 22 are formed by machining, thereby reliably preventing entry of the dust and foreign substances in the individual liquid chambers 6.

As described previously, the third surface 23 are provided between the first and second surfaces 21 and 22, respectively, such that the second surfaces 22 provided at both ends in the direction of the nozzle arrays protrude toward the common liquid chamber member 20 beyond the first surface 21 having the inlets 9 of the individual liquid chambers 6. Accordingly, even when the machining is performed to the second surfaces 22 after formation of the overcoat 30 on the first surface 21, the overcoat 30 that directly contacts the liquid is prevented from being damaged.

Specifically, during machining such as abrasive dicing, the overcoat 30 which is provided near a portion subjected to machining may be damaged by a blade used for machining. In addition, even when the blade does not directly contact the overcoat 30, a part of the overcoat 30 may be damaged by dust generated during machining. Provision of the overcoat 30 prevents the channel plate 2 from being dissolved by the liquid as described previously. Therefore, when the part of the overcoat 30 is damaged during machining, dissolution of the channel plate 2 may be started from the damaged portion. Consequently, the overcoat 30 may come off, thereby dissolving a large portion of the channel plate 2.

To solve the above-described problems, in the first illustrative embodiment, the second surfaces 22 formed by machining and the first surface 21 having the overcoat 30 thereon are disposed at different levels so that the overcoat 30 is prevented from being damaged by machining. The second surfaces 22 are formed by machining as described above, thereby increasing a bonding force between the channel member 5 and the common liquid chamber member 20.

In the comparative examples illustrated in FIGS. 5 to 8, the surface 521 of the channel member 5 is flat and therefore entirely provided with the overcoat 30. In other words, the overcoat 30 is formed also at the portions on the surface 521 of the channel member 5 to be sealed with the adhesives 24. Because chemical materials having greater durability are often used for an overcoat, bonding of the overcoat to adhesive is generally weak. Consequently, formation of the overcoat 30 at the portions on the surface 521 of the channel member 5 to be sealed with the adhesives 24 possibly causes insufficient bonding of the channel member 5 and the common liquid chamber member 20 with the adhesives 24.

By contrast, in the first illustrative embodiment, the second surfaces 22 formed in the channel plate 2 that constitutes the channel member 5 bonded to the common liquid chamber member 20 are formed by machining and are not provided with the overcoat 30. Accordingly, the second surfaces 22 without the overcoat 30 can be strongly bonded to the common liquid chamber member 20 with the adhesives 24. As a result, deterioration of bonding between the channel member 5 and the common liquid chamber member 20 over time can be prevented, thereby providing secure ejection of the liquid droplets for long periods of time.

Figure 9:
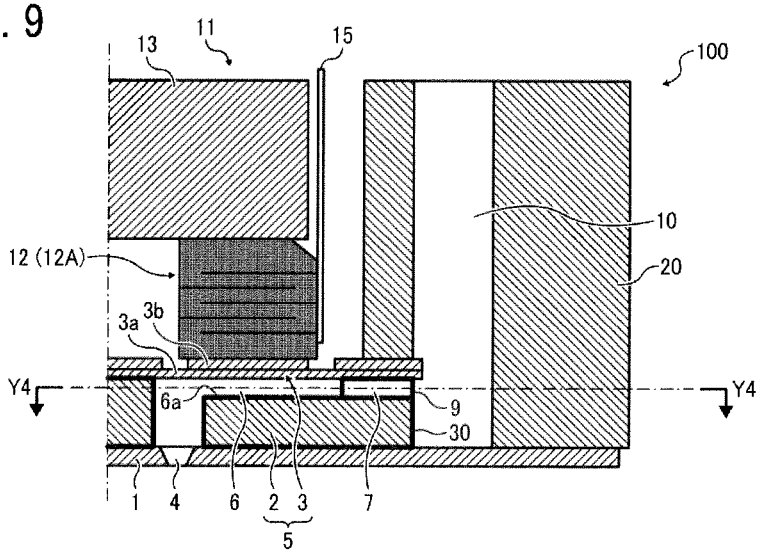
FIG. 9 is a vertical cross-sectional illustrating an example of a configuration of a liquid ejection head according to a second illustrative embodiment in the direction perpendicular to the direction of the nozzle arrays.
Figure 10:
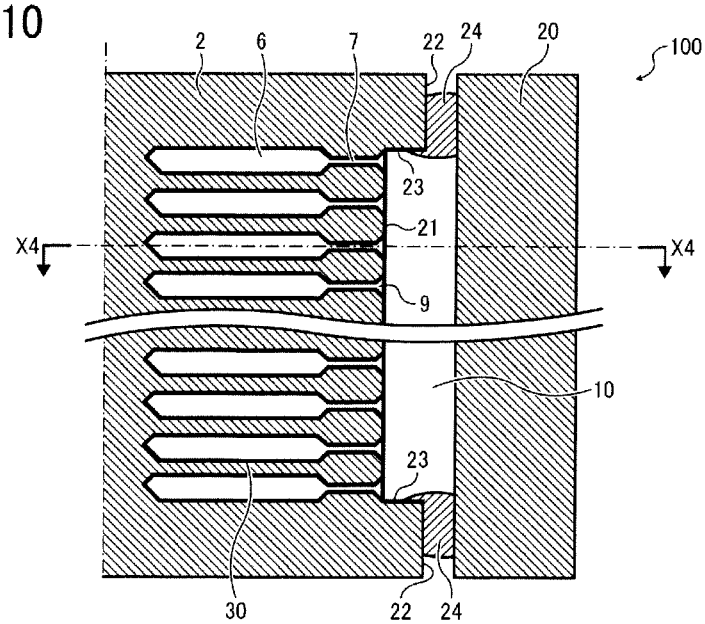
FIG. 10 is a horizontal cross-sectional view along a line Y4-Y4 in FIG. 9.

A description is now given of a configuration and operation of the liquid ejection head 100 according to a second illustrative embodiment, with reference to FIGS. 9 and 10. FIG. 9 is a vertical cross-sectional view illustrating an example of a configuration of the liquid ejection head 100 according to the second illustrative embodiment in the direction perpendicular to the direction of the nozzle arrays (which corresponds to a cross-section along a line X4-X4 in FIG. 10). FIG. 10 is a horizontal cross-sectional view along a line Y4-Y4 in FIG. 9.

In the second illustrative embodiment, each of the third surfaces 23 is formed as a step between the first and second surfaces 21 and 22. Specifically, each of the third surfaces 23 stands substantially upright from and perpendicular to the first surface 21 in the direction opposite the direction of flow of the liquid to be continuous with the second surfaces 22, respectively. As a result, even in a case of displacement of the adhesives 24, entry of the adhesives 24 in the inlets 9 of the individual liquid chambers 6 can be prevented, thereby preventing clogging of the inlets 9 with the adhesives 24. In addition, the inlets 9 can be formed even at the ends of the first surface 21 in the direction of the nozzle arrays. As a result, a size of the recessed portion formed at each end of the common liquid chamber 10 in the direction of the nozzle arrays can be reduced, thereby reducing accumulation of the bubbles at the recessed portion during filling of the liquid ejection head 100 with the liquid.

Each of the third surfaces 23 can be formed of a surface of the silicon substrate having a slower etching rate by employing a manufacturing process described in detail later. Use of the surface of the silicon substrate having a slower etching rate can precisely position the upright third surfaces 23, thereby reducing the size of the recessed portion formed at the ends of the common liquid chamber 10 as small as possible.

Figure 11:
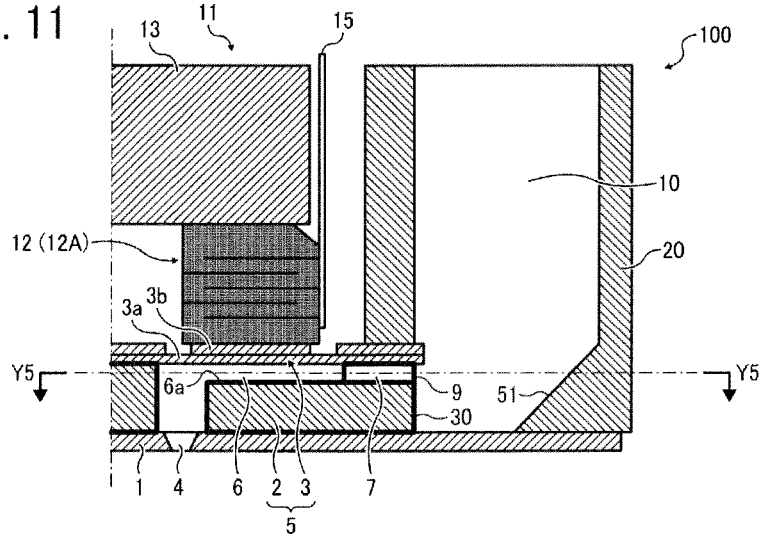
FIG. 11 is a vertical cross-sectional view illustrating an example of a configuration of a liquid ejection head according to a third illustrative embodiment in the direction perpendicular to the direction of the nozzle arrays.
Figure 12:
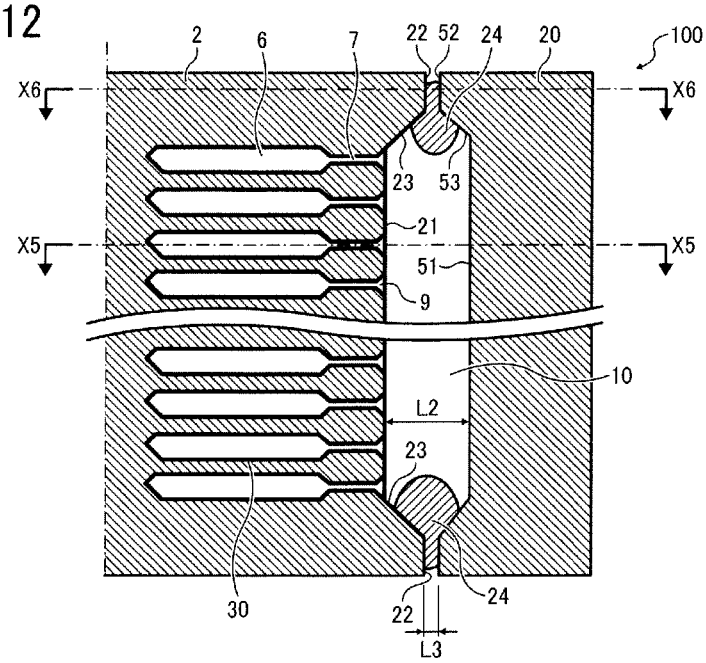
FIG. 12 is a horizontal cross-sectional view along a line Y5-Y5 in FIG. 11.
Figure 13:
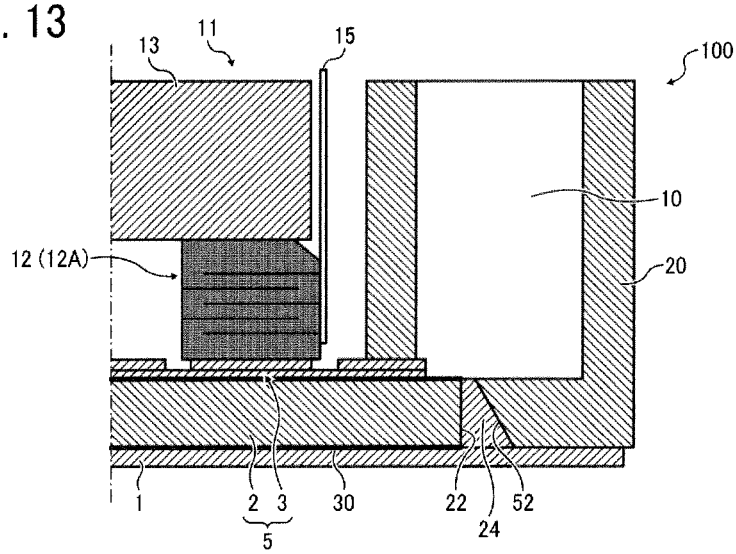
FIG. 13 is a vertical cross-sectional view along a line X6-X6 in FIG. 12.

A description is now given of a configuration and operation of the liquid ejection head 100 according to a third illustrative embodiment, with reference to FIGS. 11 to 13. FIG. 11 is a vertical cross-sectional view illustrating an example of a configuration of the liquid ejection head 100 according to the third illustrative embodiment in the direction perpendicular to the direction of the nozzle arrays (which corresponds to a cross-section along a line X5-X5 in FIG. 12). FIG. 12 is a horizontal cross-sectional view along a line Y5-Y5 in FIG. 11. FIG. 13 is a vertical cross-sectional view along a line X6-X6 in FIG. 12.

In the third illustrative embodiment, a portion of the common liquid chamber member 20 opposite the end face of the channel member 5 in the direction perpendicular to the direction of the nozzle arrays has a shape symmetrical to the shape of the end face of the channel member 5 when viewed form the horizontal direction. Specifically, the common liquid chamber member 20 has a first surface 51 disposed opposite the first surface 21 of the channel member 5, second surfaces 52 respectively provided at both ends of the common liquid chamber member 20 in the direction of the nozzle arrays, and third surfaces 53 that connect the first and second surfaces 51 and 52, respectively. The second surfaces 52 protrude toward the channel member 5 beyond the first surface 51, and the third surfaces 53 are provided at a slant such that the portion of the common liquid channel member 20 has a tapered shape from the second surfaces 52 to the first surface 51.

Accordingly, a distance L3 between the second surfaces 22 of the channel member 5 and the second surfaces 52 of the common liquid chamber member 20, both of which are bonded together with the adhesives 24, respectively, can be smaller than the distance L1 of the first illustrative embodiment (L3<L1), thereby further preventing the displacement of the adhesives 24. In addition, the width L2 of the common liquid chamber 10 between the first surface 21 of the channel member 5 and the first surface 51 of the common liquid chamber member 20 is not reduced so that the volume of the common liquid chamber 10 can be sufficiently secured in a similar manner to the first illustrative embodiment.

As illustrated in FIG. 11, the first surface 51 of the common liquid chamber member 20 is slanted to be separated from the end face of the channel member 5 as being apart from the nozzle plate 1. Further, as illustrated in FIG. 13, each of the second surfaces 52 of the common liquid chamber member 20 is slanted to approach the end face of the channel member 5 as being apart from the nozzle plate 1. As a result, even in a case of displacement of part of the adhesives 24, such adhesive expands into the third surfaces 23 of the channel member 5 and the third surfaces 53 of the common liquid chamber member 20, thereby preventing the inlets 9 of the individual liquid chambers 6 being clogged with the adhesives 24.

Figure 14:
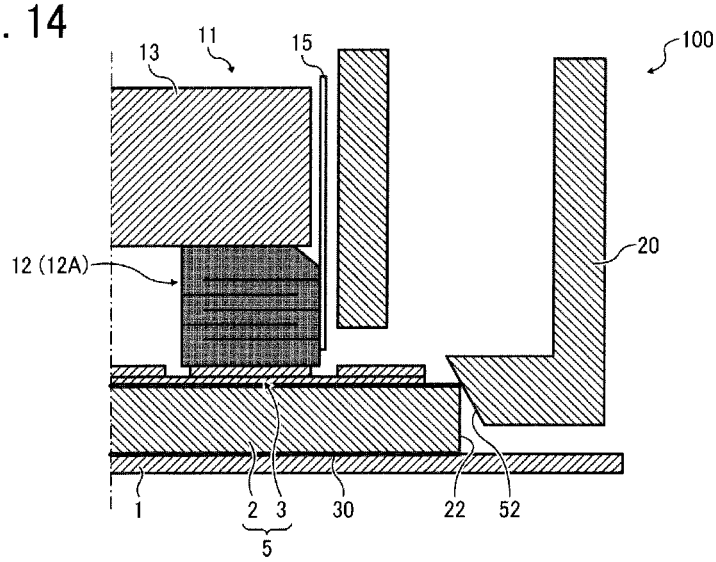
FIG. 14 is a vertical cross-sectional view illustrating assembly of the liquid ejection head according to the third illustrative embodiment.

A description is now given of assembly of the liquid ejection head 100 according to the third illustrative embodiment with reference to FIG. 14. FIG. 14 is a vertical cross-sectional view illustrating assembly of the liquid ejection head 100 according to the third illustrative embodiment.

Upon bonding of the common liquid chamber member 20 to an assembly in which the nozzle plate 1 and the channel member 5 are assembled together, the second surfaces 52 of the common liquid chamber member 20 are aligned along and bonded to the second surfaces 22 of the channel member 5, respectively. Thus, the protruding second surfaces 22 of the channel member 5 are used as a reference upon assembly. As a result, the first surface 21 is recessed in the direction of flow of the liquid compared to the second surfaces 22 so that the width L2 of the common liquid chamber 10 can be reliably secured and resistance of the liquid flowing into the inlets 9 can be reduced, thereby providing stable supply of the liquid to the individual liquid chambers 6.

Figure 15:
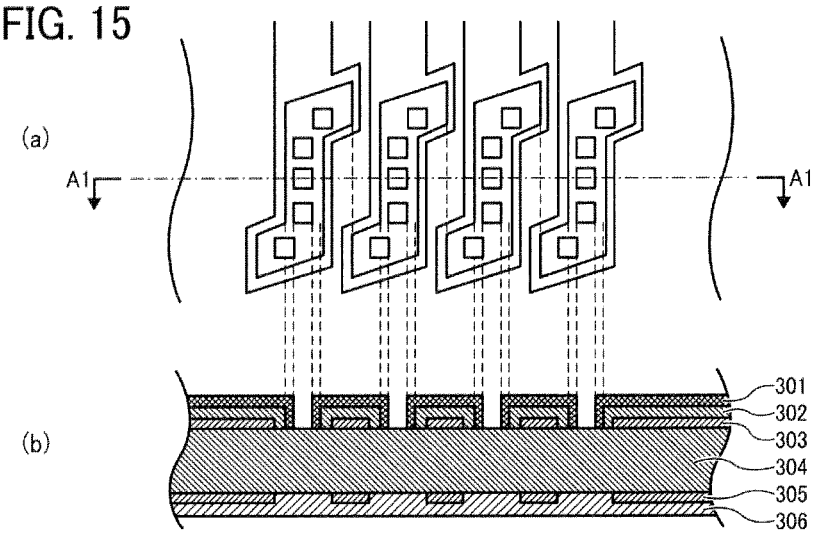
FIG. 15(*a*) is a plan view illustrating an example of manufacture of a channel plate of the liquid ejection head according to illustrative embodiments.
Figure 16:
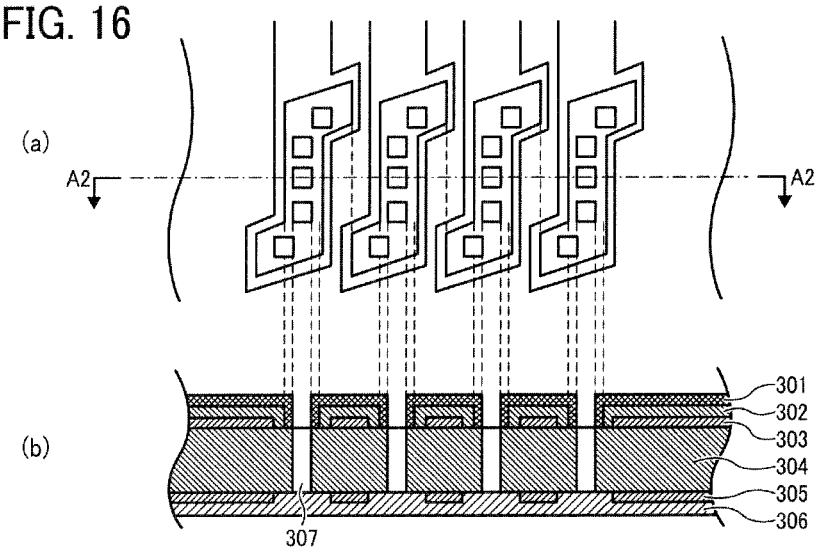
FIG. 16(*a*) is a plan view illustrating the manufacture of the channel plate after the process illustrated in FIGS. 15(*a*) and 15(*b*)
Figure 17:
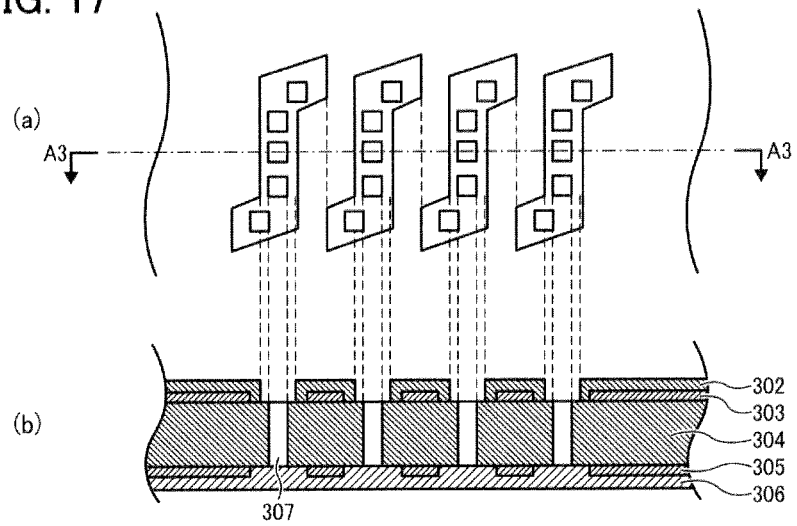
FIG. 17(*a*) is a plan view illustrating the manufacture of the channel plate after the process illustrated in FIGS. 16(*a*) and 16(*b*)
Figure 18:
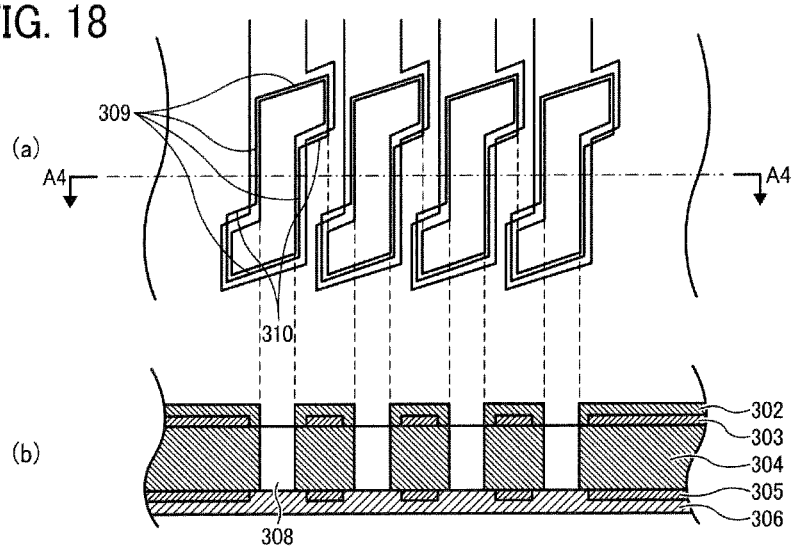
FIG. 18(*a*) is a plan view illustrating the manufacture of the channel plate after the process illustrated in FIGS. 17(*a*) and 17(*b*)
Figure 19:
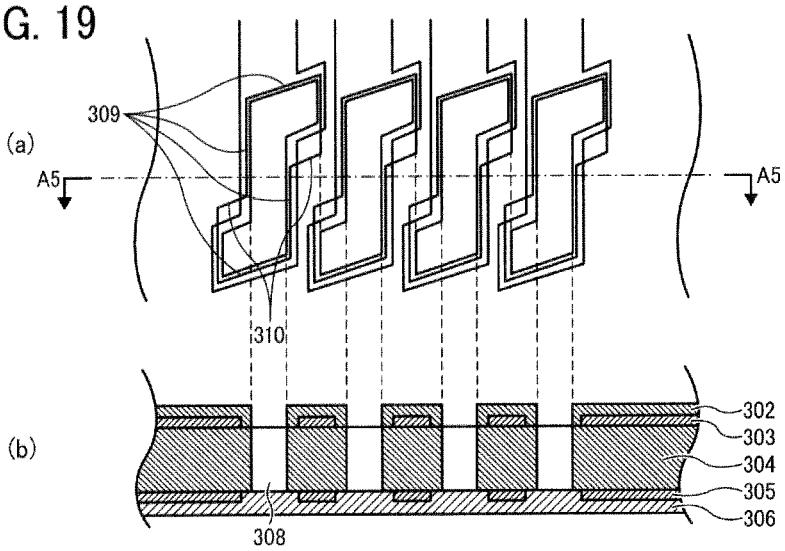
FIG. 19(*a*) is a plan view illustrating the manufacture of the channel plate after the process illustrated in FIGS. 18(*a*) and 18(*b*)
Figure 20:
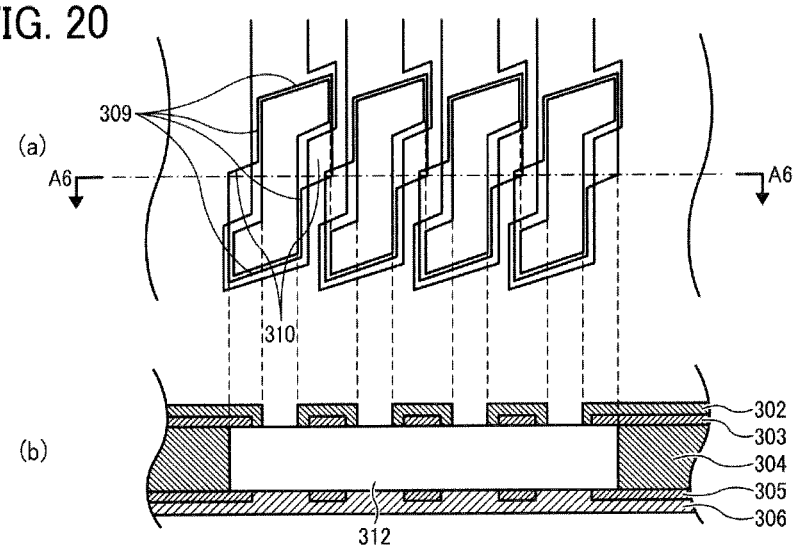
FIG. 20(*a*) is a plan view illustrating the manufacture of the channel plate after the process illustrated in FIGS. 19(*a*) and 19(*b*)
Figure 21:
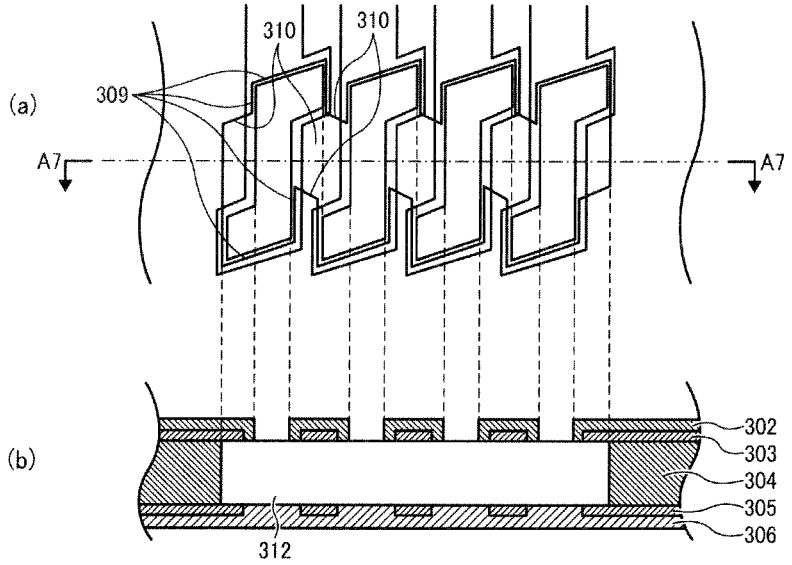
FIG. 21(*a*) is a plan view illustrating the manufacture of the channel plate after the process illustrated in FIGS. 20(*a*) and 20(*b*)
Figure 22:
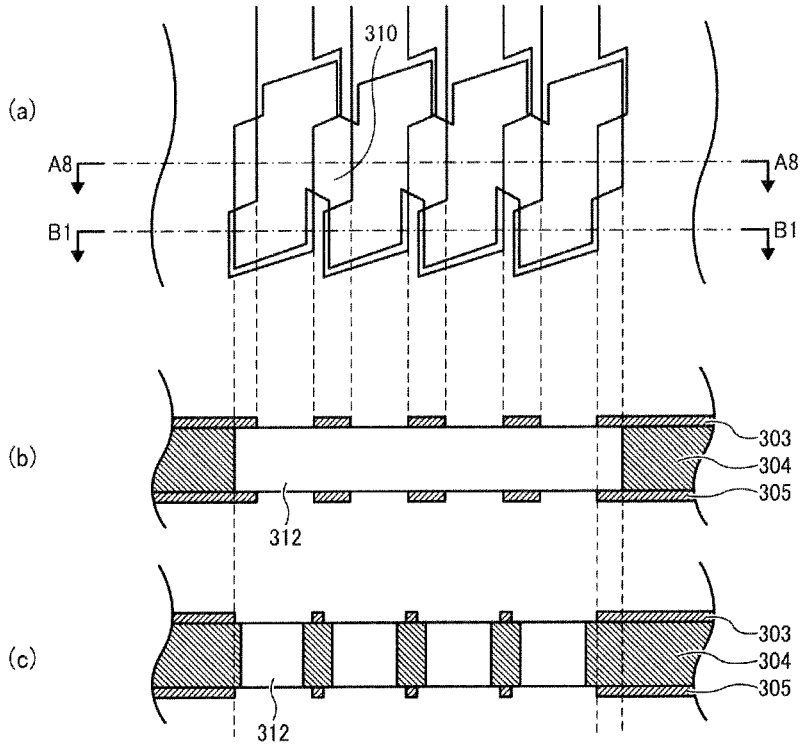
FIG. 22(*a*) is a plan view illustrating the manufacture of the channel plate after the process illustrated in FIGS. 21(*a*) and 21(*b*)
Figure 23:
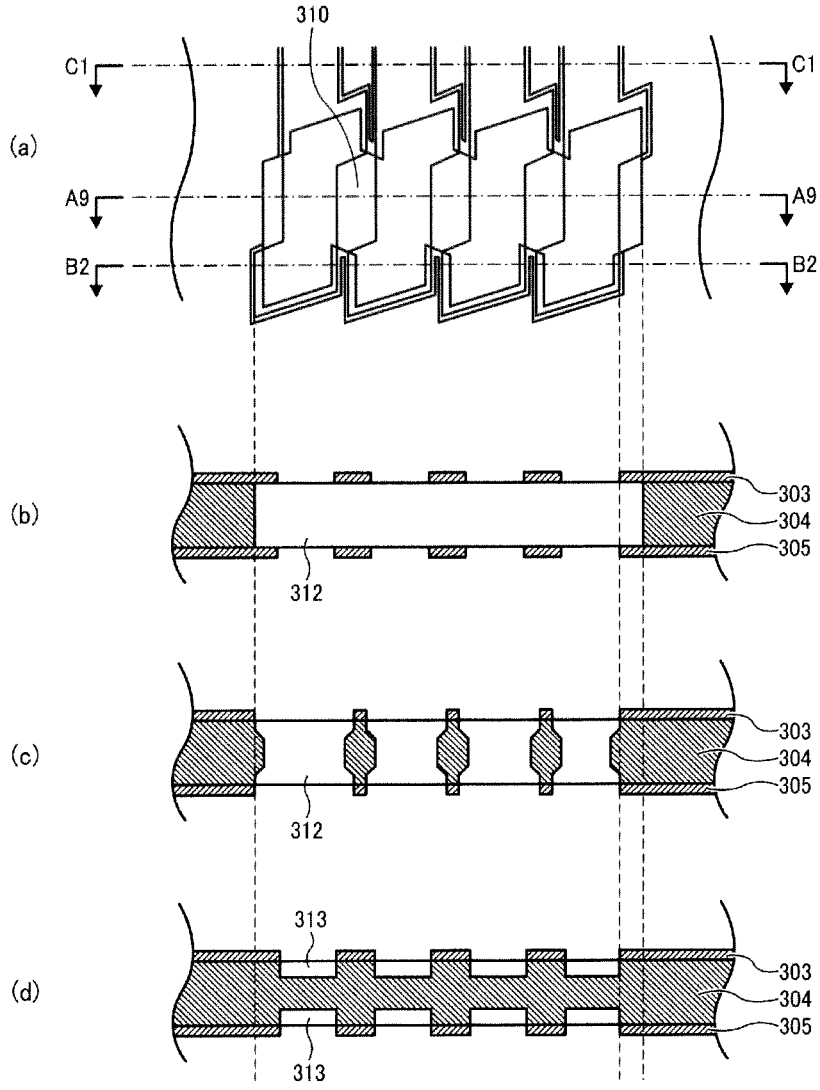
FIG. 23(*a*) is a plan view illustrating the manufacture of the channel plate after the process illustrated in FIGS. 22(*a*) to 22(*c*)
Figure 24:
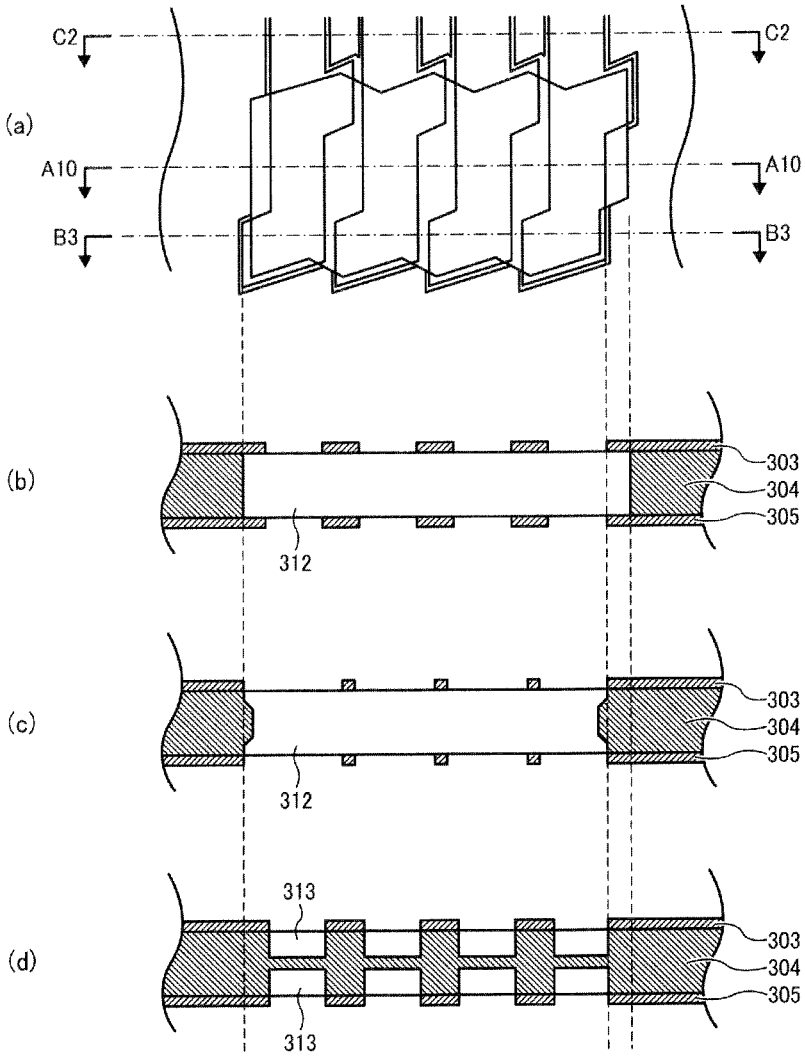
FIG. 24(*a*) is a plan view illustrating the manufacture of the channel plate after the process illustrated in FIGS. 23(*a*) to 23(*d*)
Figure 25:
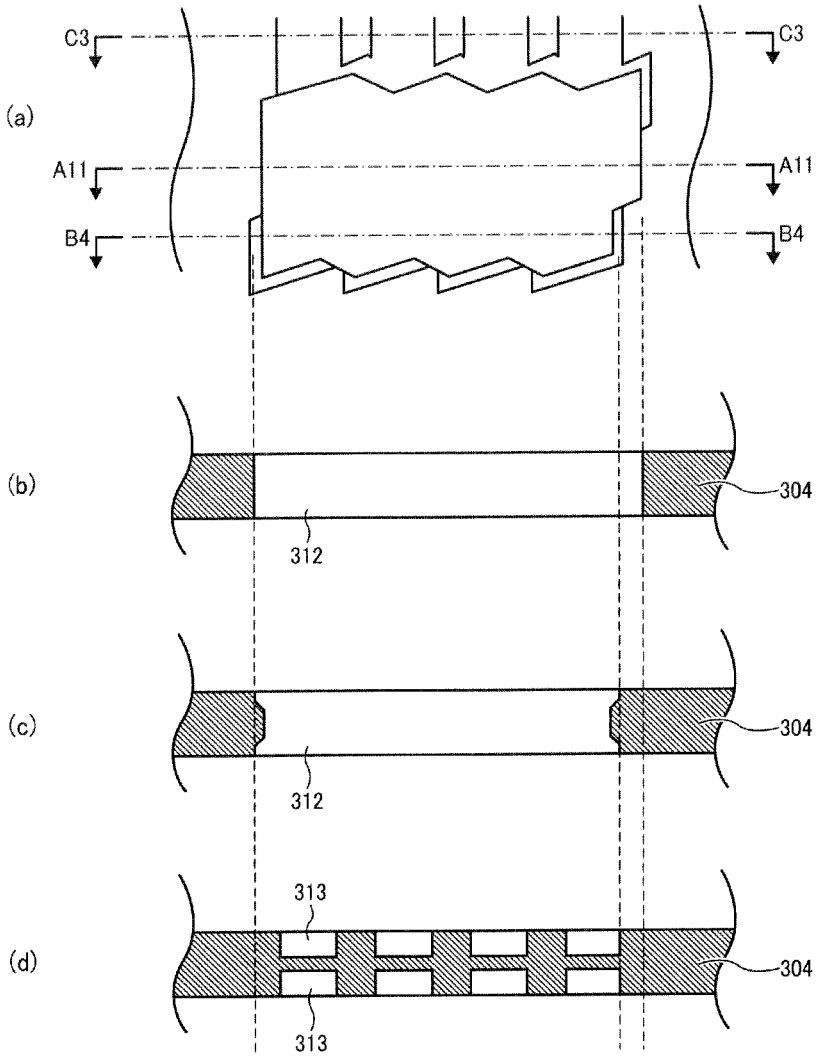
FIG. 25(*a*) is a plan view illustrating the manufacture of the channel plate after the process illustrated in FIGS. 24(*a*) to 24(*d*)
Figure 26:
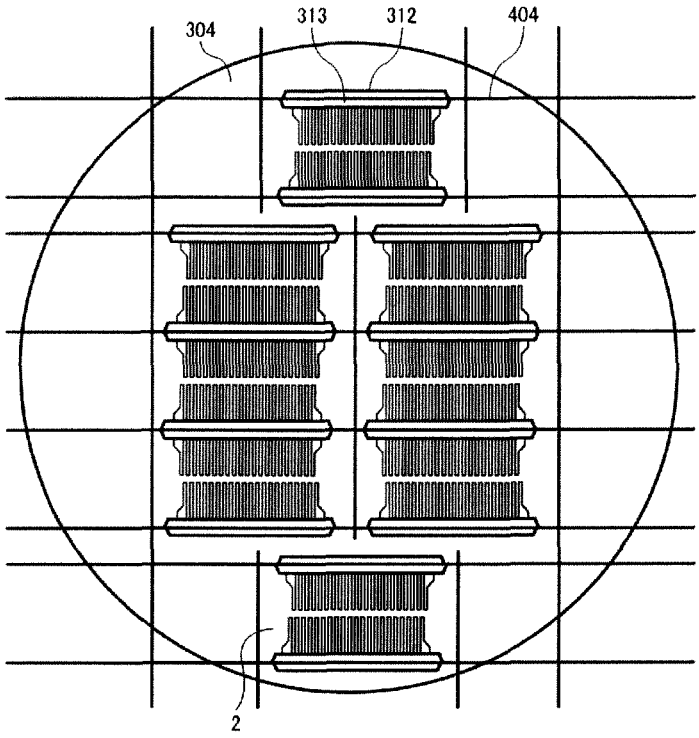
FIG. 26 is a plan view illustrating an example of a configuration of a silicon wafer in which the channel plate is formed.

A description is now given of an example of a process of manufacturing the channel plate 2 that constitutes the channel member 5 together with the vibration plate 3, with reference to FIGS. 15 to 26. FIG. 15(*a*) is a plan view illustrating an example of manufacture of the channel plate 2. FIG. 15(*b*) is a vertical cross-sectional view along a line A1-A1 in FIG. 15(*a*). FIG. 16(*a*) is a plan view illustrating the manufacture of the channel plate 2 after the process illustrated in FIGS. 15(*a*) and 15(*b*). FIG. 16(*b*) is a vertical cross-sectional view along a line A2-A2 in FIG. 16(*a*). FIG. 17(*a*) is a plan view illustrating the manufacture of the channel plate 2 after the process illustrated in FIGS. 16(*a*) and 16(*b*). FIG. 17(*b*) is a vertical cross-sectional view along a line A3-A3 in FIG. 17(*a*). FIG. 18(*a*) is a plan view illustrating the manufacture of the channel plate 2 after the process illustrated in FIGS. 17(*a*) and 17(*b*). FIG. 18(*b*) is a vertical cross-sectional view along a line A4-A4 in FIG. 18(*a*). FIG. 19(*a*) is a plan view illustrating the manufacture of the channel plate 2 after the process illustrated in FIGS. 18(*a*) and 18(*b*). FIG. 19(*b*) is a vertical cross-sectional view along a line A5-A5 in FIG. 19(*a*). FIG. 20(*a*) is a plan view illustrating the manufacture of the channel plate 2 after the process illustrated in FIGS. 19(*a*) and 19(*b*). FIG. 20(*b*) is a vertical cross-sectional view along a line A6-A6 in FIG. 20(*a*). FIG. 21(*a*) is a plan view illustrating the manufacture of the channel plate 2 after the process illustrated in FIGS. 20(*a*) and 20(*b*). FIG. 21(*b*) is a vertical cross-sectional view along a line A7-A7 in FIG. 21(*a*). FIG. 22(*a*) is a plan view illustrating the manufacture of the channel plate 2 after the process illustrated in FIGS. 21(*a*) and 21(*b*). FIG. 22(*b*) is a vertical cross-sectional view along a line A8-A8 in FIG. 22(*a*). FIG. 22(*c*) is a vertical cross-sectional view along a line B1-B1 in FIG. 22(*a*). FIG. 23(*a*) is a plan view illustrating the manufacture of the channel plate 2 after the process illustrated in FIGS. 22(*a*) to 22(*c*). FIG. 23(*b*) is a vertical cross-sectional view along a line A9-A9 in FIG. 23(*a*). FIG. 23(*c*) is a vertical cross-sectional view along a line B2-B2 in FIG. 23(*a*). FIG. 23(*d*) is a vertical cross-sectional view along a line C1-C1 in FIG. 23(*a*). FIG. 24(*a*) is a plan view illustrating the manufacture of the channel plate 2 after the process illustrated in FIGS. 23(*a*) to 23(*d*). FIG. 24(*b*) is a vertical cross-sectional view along a line A10-A10 in FIG. 24(*a*). FIG. 24(*c*) is a vertical cross-sectional view along a line B3-B3 in FIG. 24(*a*). FIG. 24(*d*) is a vertical cross-sectional view along a line C2-C2 in FIG. 24(*a*). FIG. 25(*a*) is a plan view illustrating the manufacture of the channel plate 2 after the process illustrated in FIGS. 24(*a*) to 24(*d*). FIG. 25(*b*) is a vertical cross-sectional view along a line A11-A11 in FIG. 25(*a*). FIG. 25(*c*) is a vertical cross-sectional view along a line B4-B4 in FIG. 25(*a*). FIG. 25(*d*) is a vertical cross-sectional view along a line C3-C3 in FIG. 25(*a*). FIG. 26 is a plan view illustrating an example of a configuration of a silicon wafer in which the channel plate 2 is formed.

First, as illustrated in FIGS. 15(*a*) and 15(*b*), a silicon substrate (wafer) 304 with crystal orientation <110> is provided with a resist pattern 303 for wet-etching a top surface thereof, a resist pattern 305 for wet-etching a bottom surface thereof, and a protective resist pattern 306 for the bottom surface. Then, the silicon substrate 304 is further provided with a resist pattern 302 for wet-etching the top surface and a resist pattern 301 for dry-etching.

Next, holes 307 are formed in the silicon substrate 304 using openings formed in the resist pattern 301 for dry-etching as illustrated in FIGS. 16(*a*) and 16(*b*). For example, Bosch method using an ICP etching device, which is one type of dry-etching method, may be used to easily form the holes 307 in the silicon substrate 304. Subsequently, the resist pattern 301 for dry-etching is exfoliated so that the resist pattern 302 for wet-etching the top surface is exposed at the top as illustrated in FIGS. 17(*a*) and 17(*b*). Thereafter, holes 308 are formed in the silicon substrate 304 by wet-etching as illustrated in FIGS. 18(*a*) and 18(*b*).

Wet-etching is further performed so that faces 309 with crystal orientation <111> having a slower etching rate are etched in a direction of thickness of the silicon substrate 304 without being substantially etched in the horizontal direction as illustrated in FIGS. 19(*a*) and 19(*b*).

Meanwhile, faces 310 with crystal orientation <110> and <100> each having a faster etching rate are etched in the horizontal direction below the resist patterns 302 and 303. As etching proceeds, the holes 308 adjacent to each other are connected so that a hole 312 is formed as illustrated in FIGS. 20(*a*) and 20(*b*). Etching further proceeds from the parts thus connected so that the substrate 304 now has the state shown in FIGS. 21(*a*) and 21(*b*). After etching proceeds to a certain degree, the resist pattern 302 for wet-etching the top surface and the protective resist pattern 306 for the bottom surface are exfoliated as illustrated in FIGS. 22(*a*) to 22(*c*) to form grooves. Then, etching is performed again so that corners formed upon connection of the holes 308 are etched while grooves 313 are formed by etching as illustrated in FIGS. 23(*a*) to 23(*d*).

Etching is completed when the grooves 313 have a predetermined depth. As a result, the grooves 313 and the hole 312 are formed as illustrated in FIGS. 24(*a*) to 24(*d*). Thereafter, the resist patterns 303 and 305 are exfoliated so that the silicon substrate 304 having the grooves 313 and the hole 312 is provided as illustrated in FIGS. 25(*a*) to 25(*d*). Timing to exfoliate the resist panel 302 or wet-etching the top surface and the protective resist pattern 306 for the bottom surface can be determined based on the size of the hole 312 and the depth of the grooves 313 respectively formed in the silicon substrate 304. Although the compensation patterns in which a direction of etching is changed before and after the holes 308 are connected to each other by etching process is used in the above-described example in order to form the narrow holes 307 and 308, the method for forming the holes is not limited thereto.

FIG. 26 illustrates the silicon substrate 304 to which the above-described process has been performed. After the above-described process, the silicon substrate 304 is thermally oxidized so that the grooves 313 and the hole 312 are covered with a thermal oxide film, that is, the overcoat 30. Thereafter, the silicon substrate 304 is cut along a cut line 404 so that the channel plate 2 having the first surface 21, from which the grooves 313 that constitute the grooves 6*a* are exposed, and the second surfaces 22 protruding beyond the first surface 21 can be obtained.

In a case of use of a silicone substrate with crystal orientation <110> to perform etching process, an etched face in the vertical direction remains upright relative to the bottom of the etched face due to a large difference in an etching rate caused by crystal orientation, thereby facilitating formation of a rectangular groove.

The overcoat 30 can be produced by thermally oxidizing the silicon substrate 304 having the grooves 313 and the hole 312 to form an oxidized film on the top surface of the silicon substrate 304. In a case of the silicon substrate, unoxidized silicon is dissolved in alkaline liquid. However, a speed of dissolution of oxidized silicon is considerably decreased compared to unoxidized silicon. Therefore, oxidized silicon can be used as the overcoat 30.

An overcoat other than the thermally oxidized film may be formed on the silicon substrate 304 having the grooves 313 and the hole 312 by coating the silicon substrate 304 with resin. Spray coating or dip coating may be used for coating the silicon substrate 304 with resin. Alternatively, the silicon substrate 304 may be coated with a protective agent by CVD or vapor deposition.

The silicon substrate 304 may be cut by abrasive dicing, laser dicing, separation by cleavage, or expansion of a dicing tape.

The above-described series of process allows easy formation of the channel plate 2.

In the foregoing illustrative embodiments, the piezoelectric liquid ejection head 100 in which the vibration plate 3 forms part of the walls of the individual liquid chambers 6 that constitute the channel member 5 is used. Alternatively, the foregoing illustrative embodiments are applicable to a thermal liquid ejection head in which a substrate having a heat element forms the walls of the individual liquid chambers or an electrostatic liquid ejection head.

The liquid ejection head 100 may be formed together with a tank that supplies the liquid to the liquid ejection head 100 as a single integrated cartridge.

Figure 27:
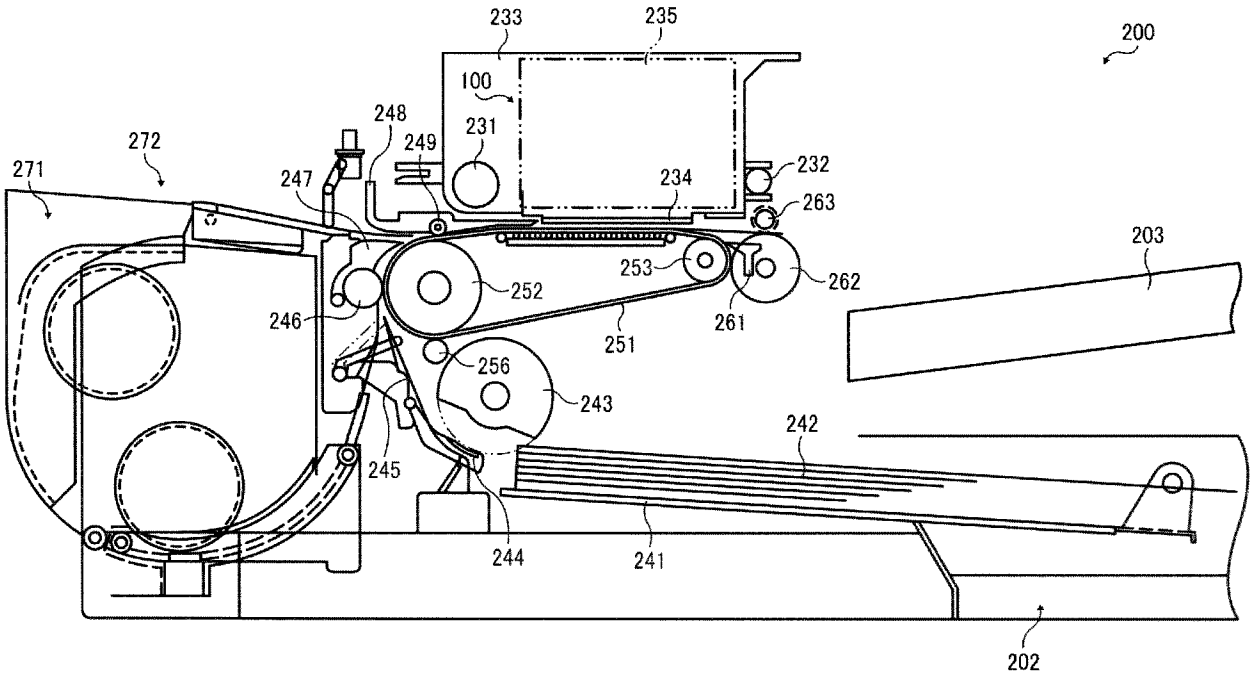
FIG. 27 is a vertical cross-sectional view illustrating an example of a configuration of an image forming apparatus according to illustrative embodiments.
Figure 28:
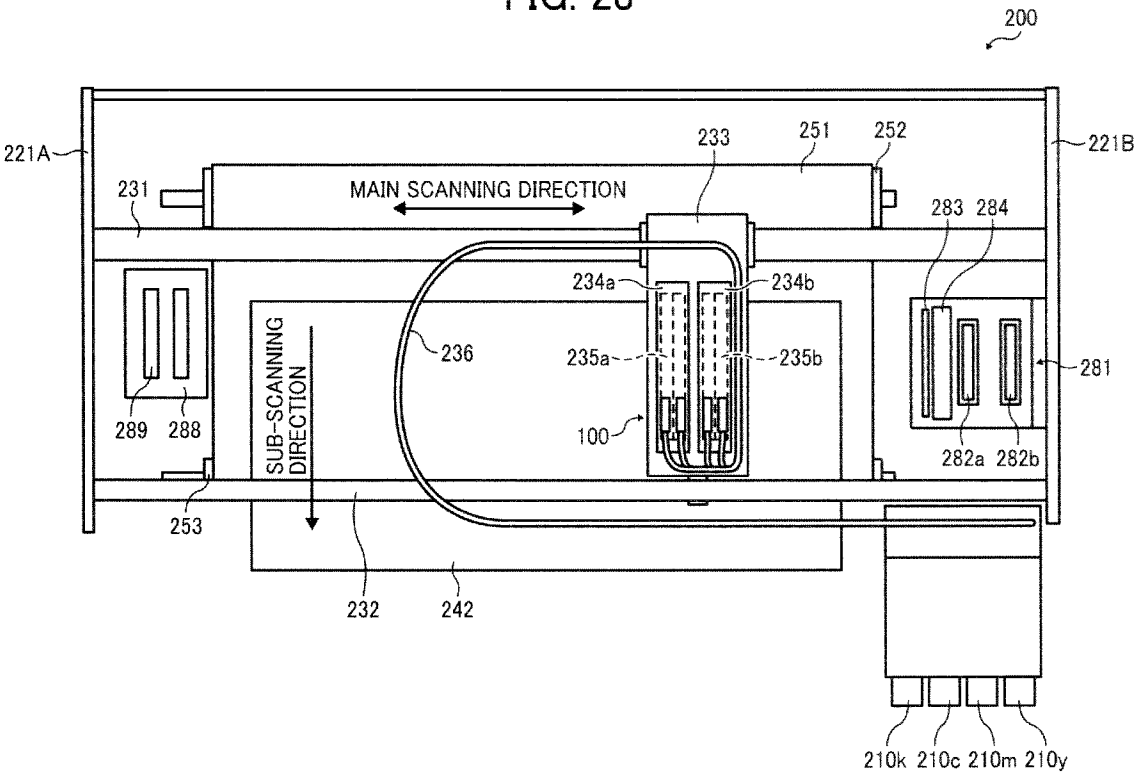
FIG. 28 is a schematic plan view illustrating an example of a configuration of a mechanism included in the image forming apparatus illustrated in FIG. 27.

A description is now given of an example of a configuration and operation of an image forming apparatus 200 including the liquid ejection head 100, with reference to FIGS. 27 and 28. FIG. 27 is a vertical cross-sectional view illustrating an example of a configuration of the image forming apparatus 200 according to illustrative embodiments. FIG. 28 is a schematic plan view illustrating an example of a configuration of a mechanism included in the image forming apparatus 200.

The image forming apparatus 200 is a serial-type image forming apparatus, and a carriage 233 is slidably supported by guide rods 231 and 232 extended between left and right lateral plates 221A and 221B in a main scanning direction.

The carriage 233 is reciprocally movable back and forth in the main scanning direction by a main scanning motor, not shown, via a timing belt.

The liquid ejection head 100 that ejects ink droplets of a specific color, that is, yellow (Y), cyan (C), magenta (M), or black (K), and a tank 235*a* or 235*b* that supplies ink to the liquid ejection head 100 are formed together as a single integrated recording head 234*a* or 234*b*. The recording heads 234*a* and 234*b* (hereinafter collectively referred to as recording heads 234) are mounted on the carriage 233. The nozzle arrays each constituted of the multiple nozzles 4 are provided to a nozzle face of each of the recording heads 234 and arrayed in a sub-scanning direction perpendicular to the main scanning direction, such that the recording heads 234 eject ink droplets of the specified colors vertically downward.

Specifically, each of the recording heads 234*a* and 234*b* has two nozzle arrays. Black ink droplets (K) are ejected from a first nozzle array formed in the recording head 234*a*, and cyan ink droplets (C) are ejected from a second nozzle array formed therein. Similarly, magenta ink droplets (M) are ejected from a first nozzle array formed in the recording head 234*b*, and yellow ink droplets (Y) are ejected from a second nozzle array formed therein. Although the two recording heads 234 are provided to eject ink droplets of four different colors in the image forming apparatus 200, alternatively, four nozzle arrays may be formed in a single recording head 234 to eject ink droplets of four different colors from the single recording head 234.

Ink is supplied from ink cartridges 210*k*, 210*c*, 210*m*, or 210*y* to the tank 235*a* or 235*b* of the recording head 234*a* or 235*b* through supply tubes 236 by a supply unit, not shown.

The image forming apparatus 200 further includes a sheet feed roller 243 and a separation pad 244, both of which separate sheets 242 placed on a sheet stand 241 of a sheet feed tray 202 to feed the sheets 242 one by one from the sheet feed tray 202 to the recording heads 234. The separation pad 244 is disposed opposite the sheet feed roller 243 to be pressed against the sheet feed roller 243 and is formed of a material having a larger frictional factor than the sheet feed roller 243.

The sheet 242 fed from the sheet feed tray 202 is conveyed to the recording heads 234 by a guide member 245 that guides the sheet 242, a counter roller 246, a conveyance guide member 247, a pressing member 248 having a pressing roller 249, and a conveyance belt 251 that electrostatically attracts the sheet 242 to convey the sheet 242 to the recording heads 234.

The conveyance belt 251 is formed of an endless belt and is wound around a conveyance roller 252 and a tension roller 253 to be rotated in the sub-scanning direction. A charging roller 256 contacts a top layer of the conveyance belt 251 to charge the conveyance belt 251 and is rotated by the rotation of the conveyance belt 251. The conveyance roller 252 is rotatively driven by a sub-scanning motor, not shown, via a timing belt to rotate the conveyance belt 251 in the sub-scanning direction, that is, a direction of conveyance of the sheet 242.

The image forming apparatus 200 further includes a separation pick 261 that separates the sheet 242 from the conveyance belt 251, and discharge rollers 262 and 263 so that the sheet 242 having an image thereon is discharged from the image forming apparatus 200 to a discharge tray 203 disposed below the discharge roller 262.

A duplex unit 271 is detachably attachable to a rear side of the image forming apparatus 200. The duplex unit 271 reverses the sheet 242 conveyed by reverse rotation of the conveyance belt 251 to further convey the sheet 242 between the counter roller 246 and the conveyance belt 251 again. An upper surface of the duplex unit 271 serves as a manual sheet feed tray 272.

A servicing mechanism 281 that services the nozzles 4 in the recording heads 234 is provided outside the imaging range of the recording heads 234 at one end of the main scanning direction of the carriage 233 to prevent irregular ejection of the ink droplets from the nozzles 4 of the recording heads 234. The servicing mechanism 281 is constructed of caps 282*a* and 282*b*, each of which covers the nozzle face of the recording head 234*a* or 234*b*, a wiper blade 283 that wipes off the nozzle face, and a receiver 284 that receives ink droplets which are not used for image formation and are preliminarily ejected from the nozzles 4 to remove coagulated ink from the nozzles 4.

The image forming apparatus 200 further includes an ink receiver 288 that receives ink droplets not used for image formation and ejected from the recording heads 234 to remove coagulated ink from the nozzles 4 of the recording heads 234 during image formation. The ink receiver 288 is disposed outside the imaging range of the recording heads 234 at the other end of the main scanning direction of the carriage 233 and includes an opening 289 formed along the direction of the nozzle arrays.

The sheet 242 fed from the sheet feed tray 202 is guided vertically upward by the guide member 245 and is conveyed by the conveyance belt 251 and the counter roller 246. A leading edge of the sheet 242 is further guided by the conveyance guide member 247 and is pressed against the conveyance belt 251 by the pressing roller 249 so that the direction of conveyance of the sheet 242 is changed substantially at 90°.

At that time, positive and negative voltages are applied alternately to the charging roller 256, that is, an alternating voltage is applied to the charging roller 256, from a voltage applicator, not shown, so that the conveyance belt 251 is charged in a pattern of an alternate charging voltages, that is, the conveyance belt 251 is alternately charged by positive and negative voltages with a predetermined width, in the direction of rotation of the conveyance belt 251 or the sub-scanning direction. Accordingly, the sheet 242 conveyed to the conveyance belt 251 thus alternately charged with the positive and negative voltages is electrostatically attracted to the conveyance belt 251 and is further conveyed in the sub-scanning direction by the rotation of the conveyance belt 251.

The recording heads 234 are driven based on image signals while the carriage 233 is moved so that ink droplets are ejected from the recording heads 234 onto the sheet 242, which remains stationary, so as to form a single line of an image to be formed on the sheet 242. Thereafter, the sheet 242 is conveyed by a predetermined amount to perform image formation of the next line. When receiving a completion signal or a signal which indicates that a trailing edge of the sheet 242 reaches the imaging range, the image forming apparatus 200 completes image formation and discharges the sheet 242 to the discharge tray 203.

The image forming apparatus 200 including the recording heads 234 each constituted of the liquid ejection head 100 according to the foregoing illustrative embodiments can securely provide higher-quality images.

It is to be noted that the foregoing illustrative embodiments are applicable not only to the serial-type image forming apparatuses but also to line-type image forming apparatuses.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A liquid ejection head comprising:

a nozzle plate having a nozzle array constructed of multiple nozzles from which liquid droplets are ejectable;

a channel member that forms multiple individual channels respectively communicating with the multiple nozzles;

a pressure generator to pressurize liquid within the multiple individual channels; and a common channel member that forms a common channel from which the liquid is supplied to the multiple individual channels, the channel member comprising:

a first surface facing the common channel member and having inlets respectively communicating with the multiple individual channels;

a second surface provided at both ends of the channel member in a direction in which the nozzle arrays extend, the second surface facing the common channel member and protruding beyond the first surface toward a direction opposite a direction of flow of the liquid from the common channel into the inlets; and a third surface that connects the first and second surfaces, at least a gap between the common channel member and a part of the second surface being sealed by a seal member that forms a wall of the common channel between the channel member and the common channel member in the direction in which the nozzle arrays extend, wherein a bonding portion of the second surface of the channel member is bonded to the common channel member, and a distance between the common channel member and the bonding portion of the second surface is smaller than a distance between the common channel member and the first surface.

2. The liquid ejection head according to claim 1, wherein:

the third surface is slanted so that the channel member is tapered inward from the second surface to the first surface; and a gap between the common channel member and an area extending across the second and third surfaces of the channel member is sealed by the seal member.

3. The liquid ejection head according to claim 1, wherein:

the first surface includes an etched portion that is not bonded to the common channel member; and the second surface includes a machined portion that is bonded to the common channel member.

4. The liquid ejection head according to claim 3, further comprising an overcoat formed on the etched first surface.

5. The liquid ejection head according to claim 4, wherein the overcoat comprises at least one of a silicon oxide film, a resin film, and an inorganic film.

6. The liquid ejection head according to claim 1, wherein the channel member has protruding portions at both ends of the channel member in the direction in which the nozzle arrays extend, the protruding portions protruding relative to the first surface in the direction opposite the direction of flow of the liquid from the common channel to the inlets.

7. The liquid ejection head according to claim 1, wherein the common channel member is bonded to a periphery of the nozzle plate and to the channel member with adhesive at different levels in a direction perpendicular to the direction in which the nozzle arrays extend.

8. An image forming apparatus comprising a liquid ejection head, the liquid ejection head comprising:

a nozzle plate having a nozzle array constructed of multiple nozzles from which liquid droplets are ejectable;

a channel member that forms multiple individual channels respectively communicating with the multiple nozzles;

a pressure generator to pressurize liquid within the multiple individual channels; and a common channel member that forms a common channel from which the liquid is supplied to the multiple individual channels, the channel member comprising:

a first surface facing the common channel member and having inlets respectively communicating with the multiple individual channels;

a second surface provided at both ends of the channel member in a direction in which the nozzle arrays extend, the second surface facing the common channel member and protruding beyond the first surface toward a direction opposite a direction of flow of the liquid from the common channel into the inlets; and a third surface that connects the first and second surfaces, at least a gap between the common channel member and a part of the second surface being sealed by a seal member that forms a wall of the common channel between the channel member and the common channel member in the direction in which the nozzle arrays extend, wherein a bonding portion of the second surface of the channel member is bonded to the common channel member, and a distance between the common channel member and the bonding portion of the second surface is smaller than a distance between the common channel member and the first surface.

9. The image forming apparatus according to claim 8, wherein the channel member has protruding portions at both ends of the channel member in the direction in which the nozzle arrays extend, the protruding portions protruding relative to the first surface in the direction opposite the direction of flow of the liquid from the common channel to the inlets.

10. The image forming apparatus according to claim 8, wherein the common channel member is bonded to a periphery of the nozzle plate and to the channel member with adhesive at different levels in a direction perpendicular to the direction in which the nozzle arrays extend.

* * * * *